US010086857B2

(12) United States Patent
Puttagunta et al.

(10) Patent No.: US 10,086,857 B2
(45) Date of Patent: Oct. 2, 2018

(54) REAL TIME MACHINE VISION SYSTEM FOR TRAIN CONTROL AND PROTECTION

(71) Applicants: Shanmukha Sravan Puttagunta, Berkeley, CA (US); Fabien Chraim, Berkeley, CA (US)

(72) Inventors: Shanmukha Sravan Puttagunta, Berkeley, CA (US); Fabien Chraim, Berkeley, CA (US)

( * ) Notice: Subject to any disclaimer, the term of this patent is extended or adjusted under 35 U.S.C. 154(b) by 0 days.

(21) Appl. No.: 14/555,501

(22) Filed: Nov. 26, 2014

(65) Prior Publication Data

US 2016/0121912 A1 May 5, 2016

Related U.S. Application Data

(60) Provisional application No. 61/909,525, filed on Nov. 27, 2013.

(51) Int. Cl.

| | |
|---|---|
| ***B61L 23/34*** | (2006.01) |
| ***B61L 27/04*** | (2006.01) |
| ***B61L 23/04*** | (2006.01) |
| ***B61L 25/02*** | (2006.01) |

(52) U.S. Cl.
CPC ..... *B61L 23/34* (2013.01); *B61L 23/041* (2013.01); *B61L 25/025* (2013.01); *B61L 27/04* (2013.01); *B61L 2205/04* (2013.01)

(58) Field of Classification Search
CPC ..... B61L 23/34; G05D 1/00
USPC ..... 701/19
See application file for complete search history.

(56) References Cited

U.S. PATENT DOCUMENTS 6,218,961 B1 4/2001 Gross
7,518,254 B2 * 4/2009 Donnelly ..... B60L 7/06 290/1 A
7,593,963 B2 9/2009 Ballesty
7,630,806 B2 * 12/2009 Breed ..... B60R 21/0134 180/273
7,688,218 B2 * 3/2010 LeFebvre ..... B61K 9/00 246/169 R
8,220,572 B2 * 7/2012 Donnelly ..... B60L 15/2045 180/65.265
8,239,078 B2 * 8/2012 Siddappa ..... B61C 17/12 455/92
8,773,535 B2 * 7/2014 Zhang ..... G06K 9/00791 348/149
8,798,821 B2 * 8/2014 Kraeling ..... B60T 13/665 375/220
8,817,021 B1 8/2014 Hickman
8,838,302 B2 * 9/2014 Kumar ..... B60L 15/38 180/14.1
8,868,335 B2 10/2014 Nowak et al.
9,014,415 B2 * 4/2015 Chen ..... G06T 7/0002 382/100
9,205,759 B2 * 12/2015 Pulliam ..... B60L 15/20
(Continued)

*Primary Examiner* — Adam D Tissot
*Assistant Examiner* — Alex C Dunn
(74) *Attorney, Agent, or Firm* — Brad Bertoglio

(57) ABSTRACT

A system, method, and apparatus are disclosed for a machine vision system that incorporates hardware and/or software, remote databases, and algorithms to map assets, evaluate railroad track conditions, and accurately determine the position of a moving vehicle on a railroad track. One benefit of the invention is the possibility of real-time processing of sensor data for guiding operation of the moving vehicle.

5 Claims, 10 Drawing Sheets

(56) References Cited

U.S. PATENT DOCUMENTS 9,245,170 B1 1/2016 Nikic
2002/0169778 A1* 11/2002 Natesan ..... G01C 21/32
2004/0249571 A1 12/2004 Biesener
2006/0020528 A1* 1/2006 Levenson ..... G06Q 40/00 705/35
2006/0244830 A1 11/2006 Davenport
2007/0233335 A1* 10/2007 Kumar ..... B61L 3/006 701/22
2008/0033605 A1* 2/2008 Daum ..... B61L 3/006 701/19
2008/0040029 A1* 2/2008 Breed ..... B60N 2/2863 701/514
2008/0042815 A1* 2/2008 Breed ..... B60N 2/2863 340/435
2008/0150786 A1* 6/2008 Breed ..... B60N 2/2863 342/53
2008/0161987 A1* 7/2008 Breed ..... G08G 1/161 701/27
2008/0255754 A1* 10/2008 Pinto ..... G01C 21/3691 701/119
2009/0105893 A1 4/2009 Kemwein
2009/0118970 A1* 5/2009 Daum ..... B61L 3/006 701/102
2010/0104199 A1 4/2010 Zhang
2011/0216063 A1 9/2011 Hayes
2011/0285842 A1 11/2011 Davenport
2012/0294532 A1 11/2012 Morris
2013/0096886 A1 4/2013 Vorobyov et al.
2013/0110804 A1* 5/2013 Davis ..... G06F 17/30967 707/706
2013/0216089 A1* 8/2013 Chen ..... G06T 7/0002 382/100
2013/0282336 A1* 10/2013 Maeda ..... G05B 23/0229 702/184
2013/0334373 A1 12/2013 Malone et al.
2013/0342362 A1* 12/2013 Martin ..... B61L 15/0027 340/870.16
2014/0067187 A1 3/2014 Ferguson et al.
2014/0200952 A1* 7/2014 Hampapur ..... B61K 9/08 705/7.28
2014/0379254 A1 12/2014 Miksa et al.

* cited by examiner

REAL TIME MACHINE VISION SYSTEM FOR TRAIN CONTROL AND PROTECTION

CROSS REFERENCE TO RELATED APPLICATIONS

The present invention claims the benefit of, priority to, and incorporates by reference, in its entirety, the follow provisional patent application under 35 U.S.C. Section 119 (e): 61/909,525, entitled Systems and Methods for Train Control Using Locomotive Mounted Computer Vision, filed Nov. 27, 2013.

FIELD OF THE INVENTION

Embodiments of the present invention relate to methods, systems, and an apparatus for optimizing real time train operation, control, and safety in intra- and inter-connected railway systems. The present invention employs a machine vision system comprised of hardware (or firmware or software) mounted to moving or stationary objects in a railway system, signaling to a remote database and processor that stores and processes data collected from multiple sources, and on-board processor that downloads data relevant for operation, safety, and/or control of a moving vehicle.

An exemplary embodiment of the system described in this invention consists of a hardware component (mounted on railroad vehicles), a remote database, and algorithms to process data collected regarding information about a rail system, including moving and stationary vehicles, infrastructure, and rail condition. The system can accurately estimate the precise position of the vehicle traveling down the track. Additional attributes about the exemplary components are detailed herein and include the following:

- the hardware: informs the movement of vehicles for safety, including identifying the track upon which they are traveling, obstructions, health of track and rail system, among other features;
- the remote database: contains information about assets, and which can be queried remotely to obtain additional asset information;
- database population with asset information: methods include machine vision data collected by the traveling vehicle itself, or by another vehicle (such as road-rail vehicles, track inspection vehicles, aerial vehicles, etc.). This data is then processed to generate the asset information (location, features, track health, among other information);
- algorithms: fuse together several data and information streams (from the sensors, the database, wayside units, the train's information bus, etc.) to result in an accurate estimate of the track ID.

BACKGROUND OF THE INVENTION

The U.S. Congress passed the U.S. Rail Safety Improvement Act in 2008 to ensure all trains are monitored in real time to enable "Positive Train Control" (PTC). This law requires that all trains report their location information such that all train movements are tracked in real time. PTC is required to function both in signaled territories and dark territories.

In order to achieve this milestone, numerous companies have tried to implement various PTC systems. A reoccurring problem is that current PTC systems can only track a train when it passes by wayside transponders or signaling stations along a railway line, rendering the operators unaware of the status of the train in between wayside signals. Therefore, the distance between consecutive physical wayside signaling infrastructures determines the minimum safe distance required between trains (headway). Current signaling infrastructure also limits the scope of deploying wayside signaling equipment due to the cost and complexity of constructing and maintaining PTC infrastructure along the length of the railway network. The current methodology for detecting trains the last time they passed near a wayside detector suffers from a lack of position information in-between transponders. A superior approach would instead enable the traveling vehicle to report its location at regular time intervals.

Certain companies went a step further to utilize radio towers along the length of the operator's track network to create virtual signals between trains, circumventing the need for wayside signaling equipment. Radio towers still require signaling equipment to be deployed in order for the radio communication to take place. However, for dependable location information, additional transponders have to be deployed along tracks for the train to reliably determine the position of the train and the track it is currently occupying.

One example of a PTC system in use is the European Train Control System (ETCS) which relies on trackside equipment and a train-mounted control that reacts to the information related to the signaling. That system relies heavily on infrastructure that has not been deployed in the United States or in developing countries.

A solution that requires minimal deployment of wayside signaling equipment would be beneficial for establishing Positive Train Control throughout the United States and in the developing world. Deploying millions of balises—the transponders used to detect and communicate the presence of trains and their location—every 1-15 km along tracks is less effective because balises are negatively affected by environmental conditions, theft, and require regular maintenance, and the data collected may not be used in real time. Obtaining positional data through only trackside equipment is not a scalable solution considering the costs of utilizing balises throughout the entire railway network PTC. Moreover, train control and safety systems cannot rely solely on a global positioning system (GPS) as it not sufficiently accurate to distinguish between tracks, thereby requiring wayside signaling for position calibration.

An advantage to the present invention described herein is that it minimizes the deployment of wayside signaling equipment and enables a train to gather contextual positional and signal compliance information that may be utilized for Positive Train Control. Utilizing instrumentation according to various aspects of the present invention on a train reduces the need for deploying expensive wayside signaling.

Another advantage of the present invention is that it collects and processes data that can be used in real-time for Positive Train Control for one or more vehicles, thereby ensuring safety for the moving vehicles in intra or inter-rail system.

Another advantage of the present invention is the use of machine vision equipment mounted on the moving vehicle. This system collects varied sensor data for on-board and remote processing.

Another advantage of the present invention is the use of machine vision algorithms for signal state identification, track identification and position refinement.

Another advantage of the present invention is the use of a backend processing and storage component. This backend relays asset location and health information to the moving vehicle, as well as to the operators.

Another advantage of the present invention is the ability to audit and augment the backend asset information from newly collected data, automatically, in real-time or offline.

BRIEF DESCRIPTION OF THE DRAWINGS

Exemplary embodiments of the present invention will now be further described with reference to the drawing, wherein like designations denote like elements, and.

DETAILED DESCRIPTION OF THE PREFERRED EMBODIMENTS

In the preferred embodiment of the present invention, referred to herein as BVRVB-PTC, or PTC vision system, or machine vision system, is a novel method for determining the position of one or more moving vehicles, e.g., trains, within an intra or inter-rail system without depending on balises/transponders for accurate positional data and using that data to optimize control and operation of the trains within the system. The invention uses a series of sensor fusion and data fusion techniques to obtain the track position with improved precision and reliability. The invention can be used for auto-braking of trains for committing red light violations on the track, for optimizing fuel based on terrain, synchronizing train speeds to avoid red lights, anti-collision systems, and for preventative maintenance of not only the trains, but also the tracks, rails, and gravel substrate underlying the tracks. The invention uses a backend processing and storage component for keeping track of asset location and health information (accessible by the moving vehicle or by railroad operators through reports).

The PTC vision system may include modules that handle communication, image capture, image processing, computational devices, data aggregation platforms that interface with the train signal bus and inertial sensors (including on-board and positional sensors).

Figure 1:
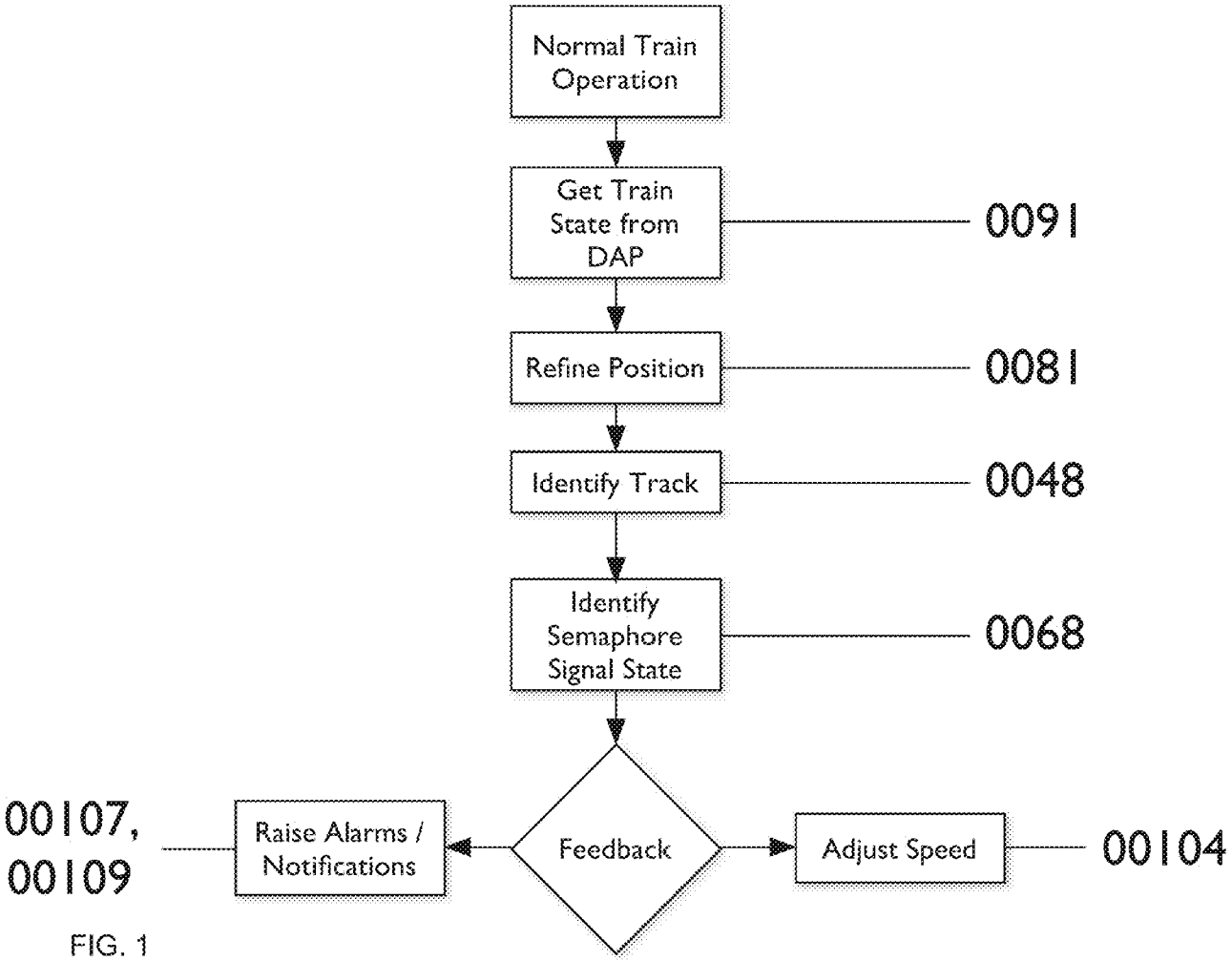
FIG. 1 is a representative flow diagram of a Train Control System.
Figure 2:
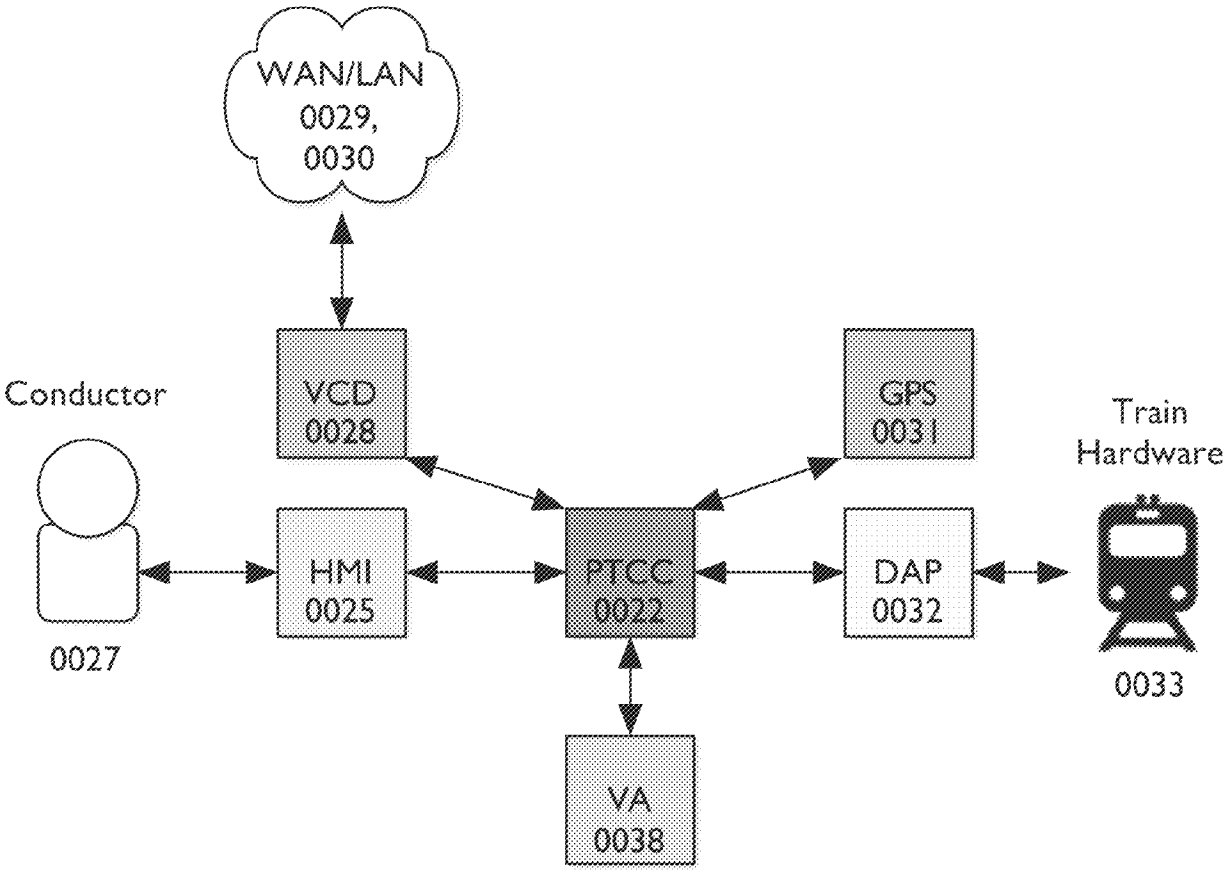
FIG. 2 is a representative flow diagram of the on board ecosystem.

Referring to FIG. 2, the PTC vision system may include one or more of the following: Data Aggregation Platform (DAP), Vision Apparatus (VA), Positive Train Control Computer (PTCC), Human Machine Interface (HMI), GPS Receiver, and the Vehicular Communication Device (VCD).

The components (e.g., VCD, HMI, PTCC, VA, DAP, GPS) may be integrated into a single component or be modular in nature and may be virtual software or a physical hardware device. Each component in the PTC vision system may have its own power supply or share one with the PTCC. The power supplies used for the components in the PTC vision system may include non-interruptible components for power outages.

The PTCC module maintains the state of information passing in between the modules of the PTC vision system. The PTCC communicates with the HMI, VA, VCD, GPS, and DAP. Communication may include providing information (e.g., data) and/or receiving information. An interface (e.g., bus, connection) between any module of the ecosystem may include any conventional interface. Modules of the ecosystem may communicate with each other, a human operator, and/or a third party (e.g., another train, conductor, train operator) using any conventional communication protocol. Communication may be accomplished via wired and/or wireless communication link (e.g., channel).

The PTCC may be implemented using any conventional processing circuit including a microprocessor, a computer, a signal processor, memory, and/or buses. A PTCC may perform any computation suitable for performing the functions of the PTC vision system.

The HMI module may receive information from the PTCC module. Information received by the HMI module may include:

- Geolocation (e.g., GPS Latitude & Longitude coordinates)
- Time
- Recommended speeds
- Directional Heading (e.g., azimuth)
- Track ID
- Distance/headway between neighboring trains on the same track
- Distance/headway between neighboring trains on adjacent tracks
- Stations of interest, including Next station, Previous station, or Stations between origin and destination
- State of virtual or physical semaphore for current track segment utilized by a train
- State of virtual or physical semaphore for upcoming and previous track segments in a train's route
- State of virtual or physical semaphore for track segments which share track interlocks with current track The HMI module may provide information to the PTCC module. Information provided to the PTCC may include information and/or requests from an operator. The HMI may process (e.g., format, reduce, adjust, correlate) information prior to providing the information to an operator or the PTCC module. The information provided by the HMI to the PTCC module may include:

- Conductor commands to slow down the train
- Conductor requests to bypass certain parameters (e.g., speed restrictions)
- Conductor acknowledgement of messages (e.g., faults, state information)
- Conductor requests for additional information (e.g., diagnostic procedures, accidents along the railway track, or other points of interest along the railway track)
- Any other information of interest relevant to a conductor's train operation The HMI provides a user interface (e.g., GUI) to a human user (e.g., conductor, operator). A human user may operate controls (e.g., buttons, levers, knobs, touch screen, keyboard) of the HMI module to provide information to the HMI module or to request information from the vision system. An operator may wear the user interface to the HMI module. The user interface may communicate with the HMI module via tactile operation, wired communication, and/or wireless communication. Information provided to a user by the HMI module may include:

- Recommended speed
- Present speed
- Efficiency score or index
- Driver profile
- Wayside signaling state
- Stations of interest
- Map view of inertial metrics
- Fault messages
- Alarms
- Conductor interface for actuation of locomotive controls
- Conductor interface for acknowledgement of messages or notifications The VCD module performs communication (e.g., wired, wireless). The VCD module enables the PTC vision system to communicate with other devices on and off the train. The VCD module may provide Wide Area Network ("WAN") and/or Local Area Network ("LAN") communications. WAN communications may be performed using any conventional communication technology and/or protocol (e.g., cellular, satellite, dedicated channels). LAN communications may be performed using any conventional communication technology and/or protocol (e.g., Ethernet, WiFi, Bluetooth, WirelessHART, low power WiFi, Bluetooth low energy, fibre optics, IEEE 802.15.4e). Wireless communications may be performed using one or more antennas suitable to the frequency and/or protocols used.

The VCD module may receive information from the PTCC module. The VCD may transmit information received from the PTCC module. Information may be transmitted to headquarters (e.g., central location), wayside equipment, individuals, and/or other trains. Information from the PTCC module may include:

- Packets addressed to other trains
- Packets addressed to common backend server to inform operators of train location
- Packets addressed to wayside equipment
- Packets addressed to wayside personnel to communicate train location
- Any node to node arbitrary payload
- Packets addressed to third party listeners of PTC vision system.

The VCD module may also provide information to the PTCC module. The VCD may receive information from any source to which the VCD may transmit information. Information provided by the VCD to the PTCC may include:

- Packets addressed from other trains
- Packets addressed from common backend server to give feedback to a conductor or a train
- Packets addressed from wayside equipment
- Packets addressed from wayside personnel to communicate personnel location
- Any node to node arbitrary payload
- Packets addressed from third party listeners of PTC vision system The GPS modules may include a conventional global positioning system ("GPS") receiver. The GPS module receives signals from GPS satellites and determines a geographical position of the receiver and time (e.g., UTC time) using the information provided by the signals. The GPS module may include one or more antennas for receiving the signals from the satellites. The antennas may be arranged to reduce and/or detect multipath signals and/or error. The GPS module may maintain a historical record of geographical position and/or time. The GPS module may determine a speed and direction of travel of the train. A GPS module may receive correction information (e.g., WAAS, differential) to improve the accuracy of the geographic coordinates determined by the GPS receiver. The GPS module may provide information to PTCC module. The information provided by the GPS module may include:

- Time (e.g., UTC, local)
- Geographic coordinates (e.g., latitude & longitude, northing & easting)
- Correction information (e.g., WAAS, differential)
- Speed
- Direction of travel The DAP may receive (e.g., determine, detect, request) information regarding a train, the systems (e.g., hardware, software) of a train, and/or a state of operation of a train (e.g., train state). For example, the DAP may receive information from the systems of a train regarding the speed of the train, train acceleration, train deceleration, braking effort (e.g., force applied), brake pressure, brake circuit status, train wheel traction, inertial metrics, fluid (e.g., oil, hydraulic) pressures, and energy consumption. Information from a train may be provided via a signal bus used by the train to transport information regarding the state and operation of the systems of the train. A signal bus includes one or more conventional signal busses such as Fieldbus (e.g., IEC 61158), Multifunction Vehicle Bus ("MVB"), wire train bus ("WTB"), controller area network bus ("CanBUS"), Train Communication Network ("TCN") (e.g., IEC 61375), and Process Field Bus ("Profibus"). A signal bus may include devices that perform wired and/or wireless (e.g., TTEthernet) communication using any conventional and/or proprietary protocol.

The DAP may further include any conventional sensor to detect information not provided by the systems of the train. Sensors may be deployed (e.g., attached, mounted) at any location on the train. Sensors may provide information to the DAP directly and/or via another device or bus (e.g., signal bus, vehicle control unit, wide train bus, multifunction vehicle bus). Sensors may detect any physical property (e.g., density, elasticity, electrical properties, flow, magnetic properties, momentum, pressure, temperature, tension, velocity, viscosity). The DAP may provide information regarding the train to the other modules of the PTC ecosystem via the PTCC module.

The DAP may receive information from any module of the PTC ecosystem via the PTCC module. The DAP may provide information received from any source to other modules of the PTC ecosystem via the PTCC module. Other modules may use information provided by or through the DAP to perform their respective functions.

The DAP may store received data. The DAP may access stored data. The DAP may create a historical record of received data. The DAP may relate data from one source to another source. The DAP may relate data of one type to data of another type. The DAP may process (e.g., format, manipulate, extrapolate) data. The DAP may store data that may be used, at least in part, to derive a signal state of the track on which the train travels, geographic position of the train, and other information used for positive train control.

The DAP may receive information from the PTCC module. Information received by the DAP from the PTCC module may include:

- Requests for train state data
- Requests for braking interface state
- Commands to actuate train behavior (speed, braking, traction effort)
- Requests for fault messages
- Acknowledgement of fault messages Requests to raise alarms in the train
Requests for notifications of alarms raised in the train
Requests for wayside equipment state The DAP may provide information to the PTCC module. Information provided by the DAP to the PTCC module may include:

Data from the signal bus of the train regarding train state
Acknowledge of requests
Fault messages on train bus
Wayside equipment state The VA module detects the environment around the train. The VA module detects the environment through which a train travels. The VA module may detect the tracks upon which the train travels, tracks adjacent to the tracks traveled by the train, the aspect (e.g., appearance) of wayside (e.g., along tracks) signals (semaphore, mechanical, light, position), infrastructure (e.g., bridges, overpasses, tunnels), and/or objects (e.g., people, animals, vehicles). Additional examples include:

PTC assets
ETCS assets
Tracks
Signals
Signal lights
Permanent speed restrictions
Catenary structures
Catenary wires
Speed limit Signs
Roadside safety structures
Crossings
Pavements at crossings
Clearance point locations for switches installed on the main and siding tracks
Clearance/structure gauge/kinematic envelope
Beginning and ending limits of track detection circuits in non-signaled territory
Sheds
Stations
Tunnels
Bridges
Turnouts
Cants
Curves
Switches
Ties
Ballast
Culverts
Drainage structures
Vegetation ingress
Frog (crossing point of two rails)
Highway grade crossings
Integer mileposts
Interchanges
Interlocking/control point locations
Maintenance facilities
Milepost signs
Other signs and signals The VA module may detect the environment using any type of conventional sensor that detects a physical property and/or a physical characteristic. Sensors of the VA module may include cameras (e.g., still, video), remote sensors (e.g., Light Detection and Ranging), radar, infrared, motion, and range sensors. Operation of the VA module may be in accordance with a geographic location of the train, track conditions, environmental conditions (e.g., weather), speed of the train. Operation of the VA may include the selection of sensors that collect information and the sampling rate of the sensors.

The VA module may receive information from the PTCC module. Information provided by the PTCC module may provide parameters and/or settings to control the operation of the VA module. For example, the PTCC may provide information for controlling the sampling frequency of one or more sensors of the VA. The information received by the VA from the PTCC module may include:

The frequency of the sampling
The thresholds for the sensor data
Sensor configurations for timing and processing The VA module may provide information to the PTCC module. The information provided by the VA module to the PTCC module may include:

Present sensor configuration parameters
Sensor operational status
Sensor capability (e.g., range, resolution, maximum operating parameters)
Raw or processed sensor data
Processing capability
Data formats Raw or processed sensor data may include a point cloud (e.g., two-dimensional, three-dimensional), an image (e.g., jpg), a sequence of images, a video sequence (e.g., live, recorded playback), scanned map (e.g., two-dimensional, three-dimensional), an image detected by Light Detection and Ranging (e.g., LIDAR), infrared image, and/or low light image (e.g., night vision). The VA module may perform some processing of sensor data. Processing may include data reduction, data augmentation, data extrapolation, and object identification.

Sensor data may be processed, whether by the VA module and/or the PTCC module, to detect and/or identify:

Track used by the train
Distance to tracks, objects and/or infrastructure
Wayside signal indication (e.g., meaning, message, instruction, state, status)
Track condition (e.g., passable, substandard)
Track curvature
Direction (e.g., turn, straight) of upcoming segment
Track deviation from horizontal (e.g., declivity, acclivity)
Junctions
Crossings
Interlocking exchanges
Position of train derived from environmental information
Track identity (e.g., track ID)

The VA module may be coupled (e.g., mounted) to the train. The VA module may be coupled at any position on the train (e.g., top, inside, underneath). The coupling may be fixed and/or adjustable. An adjustable coupling permits the viewpoint of the sensors of the VA module to be moved with respect to the train and/or the environment. Adjustment of the position of the VA may be made manually or automatically. Adjustment may be made responsive to a geographic position of the train, track condition, environmental conditions around the train, and sensor operational status.

The PTCC utilizes its access to all subsystems (e.g., modules) of the PTC system to derive (e.g., determine, calculate, extrapolate) track ID and signal state from the sensor data obtained from the VA module. In addition, the PTCC module may utilize the train operating state information, discussed above, and data from the GPS receiver to refine geographic position data. The PTCC module may also use information from any module of the PTC environment, including the PTC vision system, to qualify and/or interpret sensor information provided by the VA module. For example, the PTCC may use geographic position information from the GPS module to determine whether the infrastructure or signaling data detected by the VA corresponds to a particular location. Speed and heading (e.g., azimuth) information derived from video information provided by the VA module may be compared to the speed and heading information provided by the GPS module to verify accuracy or to determine likelihood of correctness. The PTCC may use images provided by the VA module with position information from the GPS module to prepare map information provided to the operator via the user interface of the HMI module. The PTCC may use present and historical data from the DAP to detect the position of the train using dead reckoning, position determination may be correlated to the location information provided by the VA module and/or GPS module. The PTCC may receive communications from other trains or wayside radio transponders (e.g., balises) via the VCD module for position determination that may be correlated and/or corrected (e.g., refined) using position information from the VA module and/or the GPS module or even dead reckoning position information from the DAP. Further, track ID, signal state, or train position may be requested to be entered by the operator via the HMI user interface for further correlation and/or verification.

The PTCC module may also provide information and calls to action (e.g., messages, warnings, suggested actions, commands) to a conductor via the HMI user interface. Using control algorithms, the PTCC may bypass the conductor and actuate a change in train behavior (e.g., function, operation) utilizing the integration with the braking interface or the traction interface to adjust the speed of the train. PTCC handles the routing of information by describing the recipient(s) of interest, the payload, frequency, route and duration of the data stream to share the train state with third party listeners and devices.

The PTCC may also dispatch/receive packets of information automatically or through calls to action from the common backend server in the control room or from the railway operators or from the control room terminal or from the conductor or from wayside signaling or modules in the PTC vision system or other third party listeners subscribed to the data on the train.

The PTCC may also receive information concerning assets near the location of the moving vehicle. The PTCC may use the VA to collect data concerning PTC and other assets. The PTCC may also process the newly collected data (or forward it) to audit and augment the information in the backend database.

Figure 6:
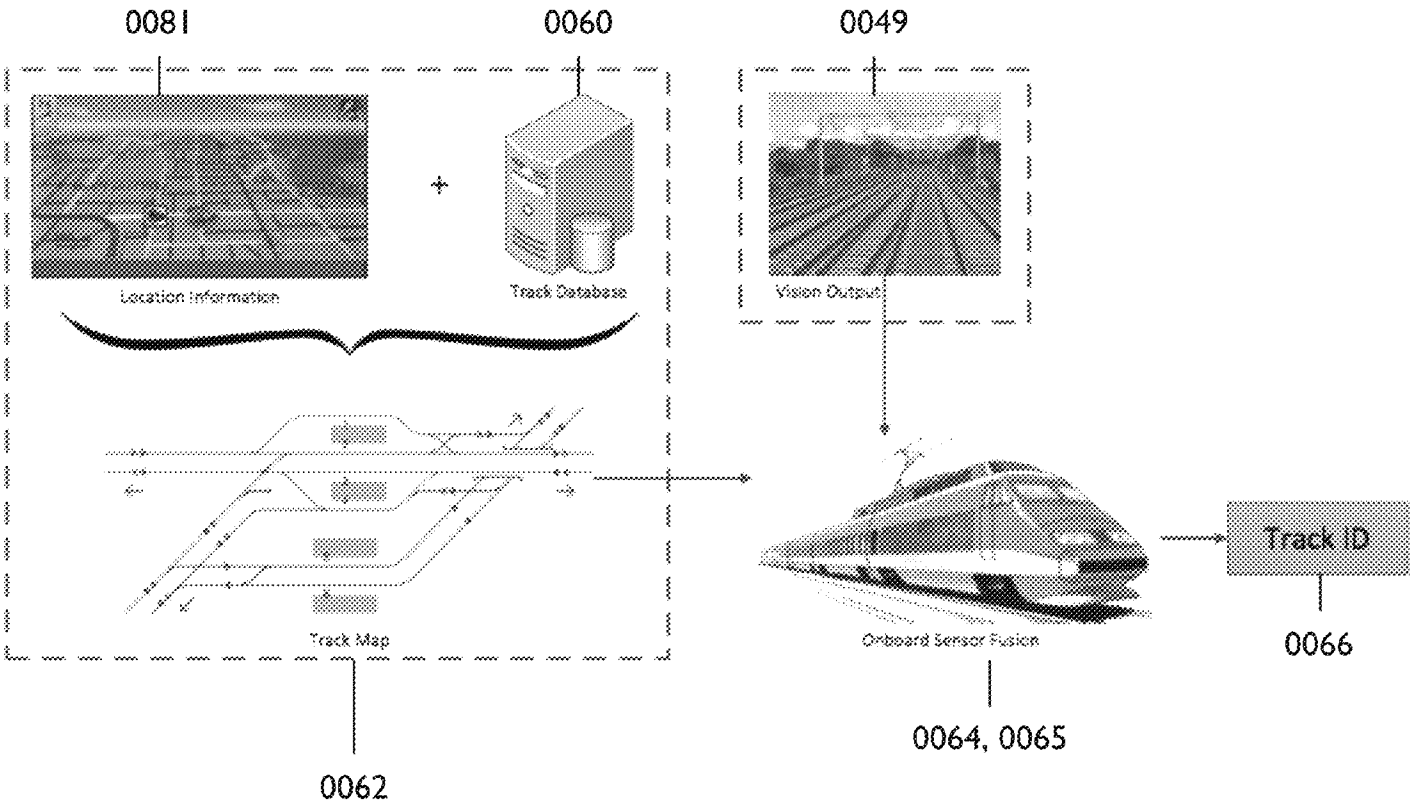
FIG. 6 is a representative flow diagram for obtaining the track ID occupied by the train.
Figure 7:
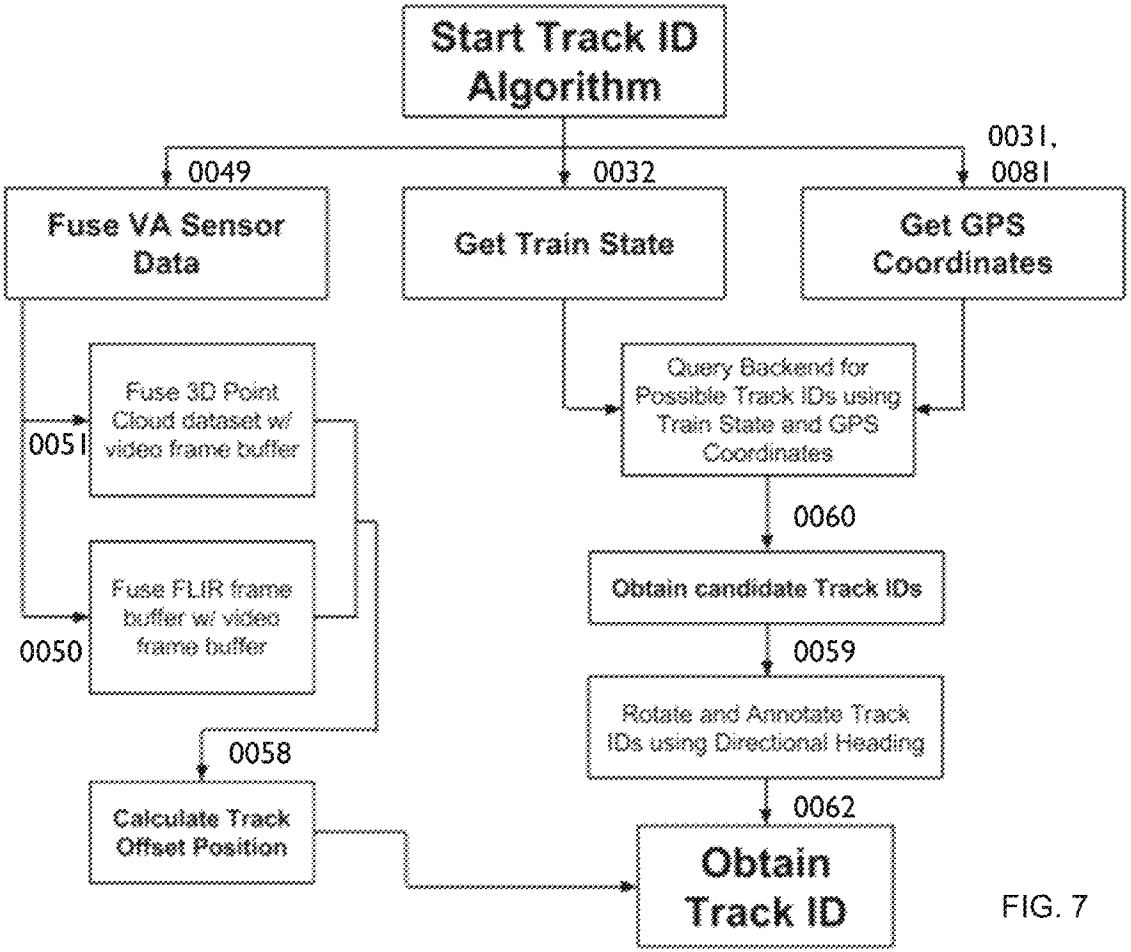
FIG. 7 is a representative flow diagram which describes the track ID algorithm.

Algorithms: The Track Identification Algorithm (TIA), depicted in FIGS. 6-7 determines which track the rolling stock is currently utilizing. The TIA creates a superimposed feature dataset by overlaying the features from the 3D LIDAR scanners and FLIR Cameras onto the onboard camera frame buffer. The superset of features (global feature vector) allows for three orthogonal measurements and perspectives of the tracks.

Thermal features from the FLIR Camera may be used to identify (e.g., separate, locate, isolate) the thermal signature of the railway tracks to generate a region of interest (spatial & temporal filters) in the global feature vector.

Range information from the 3D LIDAR scanner's 3D point cloud dataset may be utilized to identify the elevation of the railway track to also generate a region of interest (spatial & temporal filters) in the global feature vector.

Line detection algorithms may be utilized on the onboard camera, FLIR cameras and 3D LIDAR scanner's 3D point cloud dataset to further increase confidence in identifying tracks.

Color information from the onboard camera and the FLIR cameras may be used to also create a region of interest (spatial & temporal filter) in the global feature vector.

The TIA may look for overlaps in the regions of interest from multiple orthogonal measurements on the global feature vector to increase redundancy and confidence in track identification data.

The TIA may utilize the region of interest data to filter out false positives when the regions of interest do not overlap in the global feature vector.

The TIA may process the feature vectors in a region of interest to identify the width, distance, and curvature of a track.

The TIA may examine the rate at which a railway track is converging towards a point to further validate the track identification process; furthermore the slope of a railway track may also be used to filter out noise in the global feature vector dataset.

The TIA may take into consideration the spatial and temporal consistency of feature vectors prior to identifying the relative offset position of a train amongst multiple railway tracks.

Directional heading may be obtained by sampling the GPS receiver multiple times to create a temporal profile of movement in geographic coordinates.

The list of potential absolute track IDs may be obtained through a query to a locally cached GIS dataset or a remotely hosted backend server.

In a situation wherein the GPS receiver loses synchronization with GPS satellites, the odometer and directional heading may be used to calculate the dead reckoning offset.

The TIA compares the relative offset position of the train among multiple railway tracks and references to the list of potential absolute track IDs to identify the absolute track ID that the train is utilizing.

After the TIA obtains an absolute track ID, the global feature vector samples may be annotated with the geolocation (e.g., geographic coordinate) information and track ID. This allows the TIA to utilize the global feature vector datasets to directly determine a track position in the future. This machine learning approach reduces the computational cost of searching for an absolute track ID.

The TIA may further match global feature vector samples from a local or backend database with spatial transforms. The parameters of the spatial transform may be utilized to calculate an offset position from a reference position generated from the query match.

Furthermore, the TIA may utilize the global feature vectors to stitch together features from multiple points in space or from a single point in space using various image processing techniques (e.g., image stitching, geometric registration, image calibration, image blending). This results in a superset of feature data that has collated global feature vectors from multiple points or a single point in space.

Figure 10:
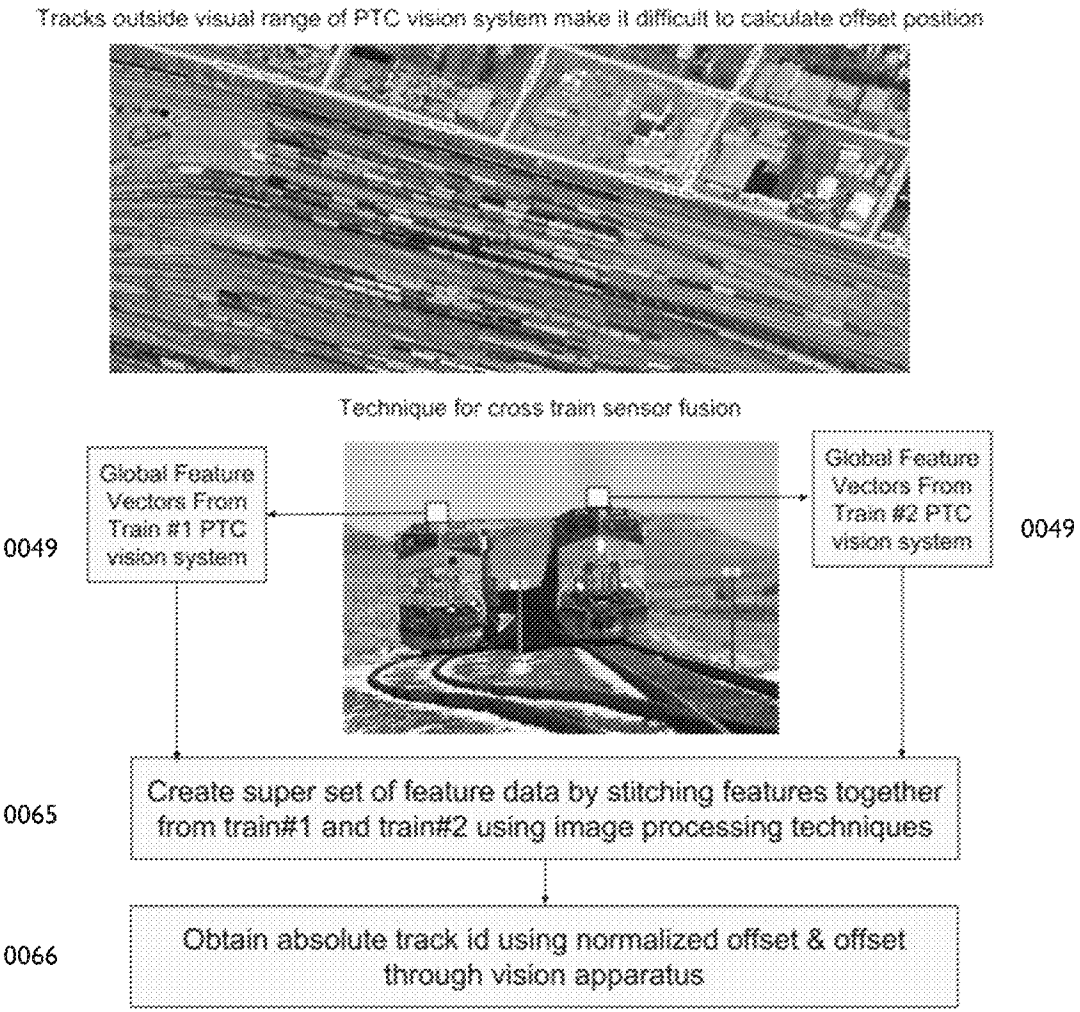
FIG. 10 is a representative flow diagram of image stitching techniques for relative track positioning.

Utilizing the superset of data, the TIA can normalize the offset position for a relative track ID prior to determining an absolute track ID. This is useful when there are tracks outside the range of the vision apparatus (VA). This functionality is depicted in FIG. 10.

The TIA is a core component in the PTC vision system that eliminates the need for wireless transponders, beacons or balises to obtain positional data. TIA may also enable railway operators to annotate newly constructed railway tracks for their network wide GIS datasets that are authoritative in mapping the wayside equipment and infrastructure assets.

Figure 4:
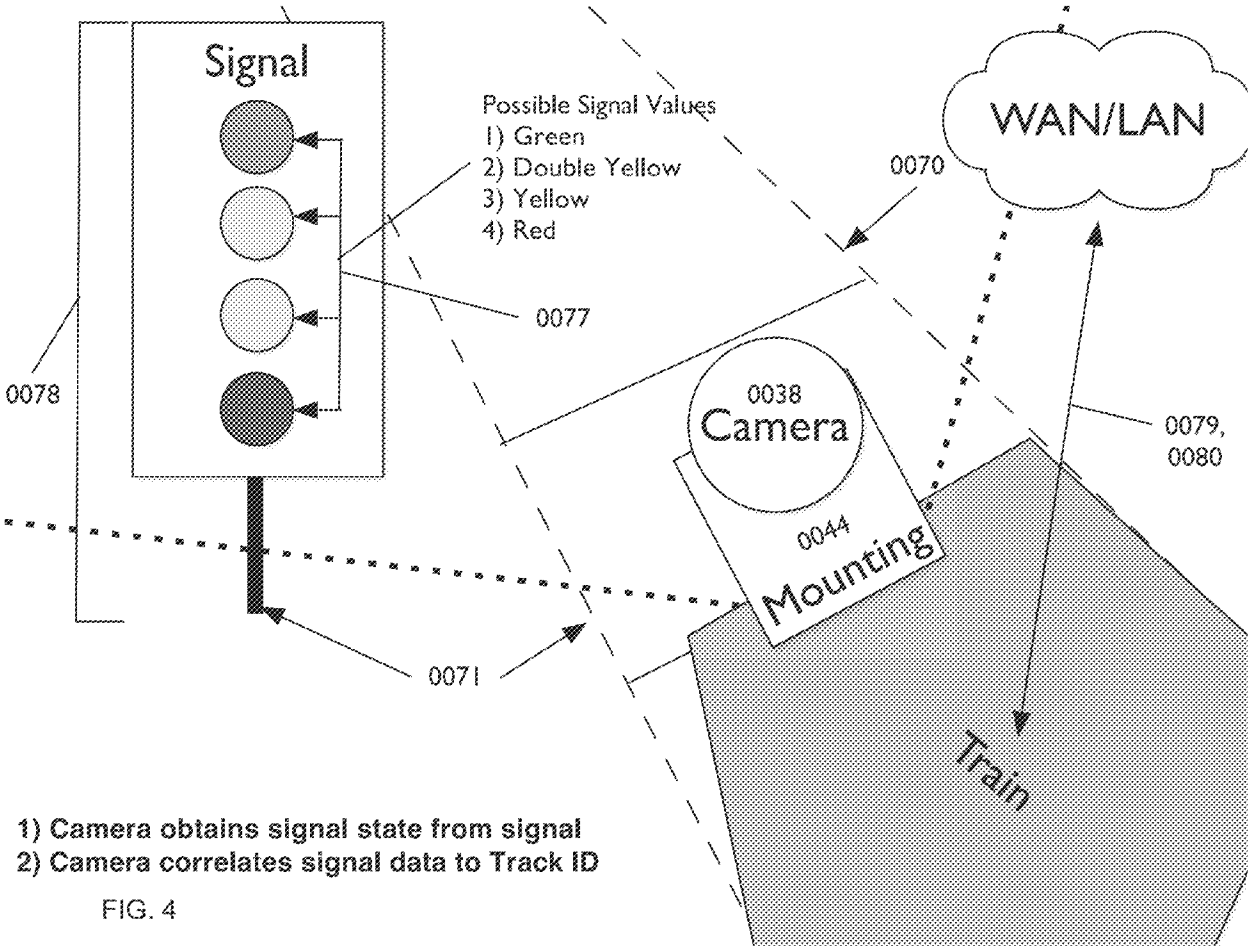
FIG. 4 is an exemplary depiction of a train extrapolating the signal state.
Figure 8:
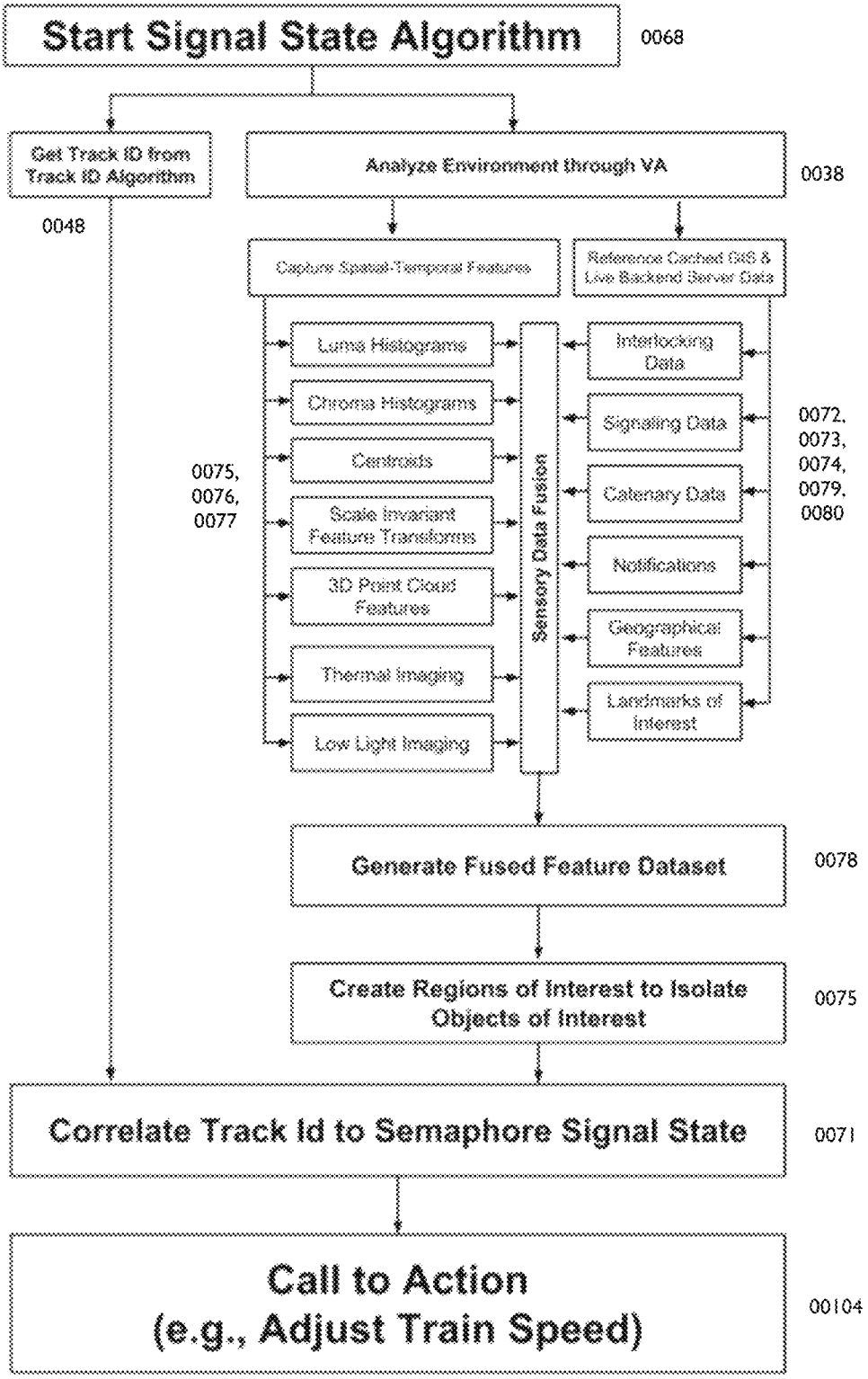
FIG. 8 is a representative flow diagram which describes the signal state algorithm.

The Signal State Algorithm (SSA), described in FIG. 8, determines the signal state of the track a train is currently utilizing. The purpose of this component is to ensure a train's operation is in compliance with the expected operational parameters of the railway operators or modal control rooms or central control rooms. The compliance of a train's inertial metrics along a railway track can be audited in a distributed environment many backend servers or a centralized environment with a common backend server. A train's ability to obtain the absolute track ID is important for correlating the semaphore signal state to the track ID utilized by a train. Auditing signal compliance is possible once the correlation between the semaphore signal state and the absolute track ID is established. Placement of sensors is important for efficiently determining a semaphore signal state. FIG. 4 depicts one example wherein the 3D LIDAR scanner is forward facing and mounted on top of a train's roof.

The SSA takes into account an absolute track ID utilized by a train in order to audit the signal compliance of the train. Once the correlation of a track to a semaphore signal is complete, the signal state from that semaphore signal may actuate calls to action as feedback to a train or conductor.

Correlation of a railway track to a semaphore signal state may be possible by analyzing the regulatory specifications for wayside signaling from a railway operator. Utilizing the regulatory documentation, the spatial-temporal consistency of a semaphore signal may be compared to the spatial-temporal consistency of a railway track. A scoring mechanism may be used to choose the best candidate semaphore signal for the current railway track utilized by the train.

A local or remote GIS dataset may be queried to confirm the geolocation of a semaphore signal.

A local or remote signaling server may be queried to confirm the signal state in the semaphore signal matches what the PTC vision system is extrapolating.

Areas wherein the signal state is available to the train via radio communication may be utilized to confirm the accuracy of the PTC vision system and additionally augment the feedback provided to a machine learning apparatus that helps tune the PTC vision system.

A 3D point cloud dataset obtained from a PTC vision system may be utilized to analyze the structure of the semaphore signal. If the structure of an object of interest matches the expected specifications as defined by the regulatory body for a semaphore signal in that rail corridor, the object of interest may be annotated and added as a candidate for the scoring mechanism referenced above.

An infrared image captured through an FLIR camera may be utilized to identify the light being emitted from a wayside semaphore signal. In a situation where the red light is emitting from a candidate semaphore signal that is correlated to a track the train is currently on, a call to action will be dispatched to the HMI onboard the train for signal compliance. Upon a train's failure to comply with a semaphore signal that is correlated to a track the train is currently on, a call to action will be dispatched directly to the braking interface onboard the train for signal compliance.

The color spectrum in an image captured through the PTC vision system may be segmented to compute centroids that are utilized to identify blobs that resemble signal green, red, yellow or double yellow lights. A centroid's spatial coordinates and size of its blob may be utilized to validate the spatial-temporal consistency of the semaphore signal with specifications from a regulatory body.

A spatial-temporal consistency profile of a track may be created by analyzing the curvature of a track, spacing between the rails on a track, and rate of convergence of the track spacing towards a point on the horizon. A spatial-temporal consistency profile of a semaphore signal may be created by analyzing the following components: the height of a semaphore signal, the relative spatial distance between points in space, and the orientation and distance with respect to a track a train is currently utilizing.

The backend server may be queried to inform a train of an expected semaphore signal state along a railway track segment that the train is currently utilizing.

The backend server may be queried to inform a train of an expected semaphore signal state along a railway track segment identified by an absolute track ID and geolocation coordinates. 571-272-4100

Figure 3:
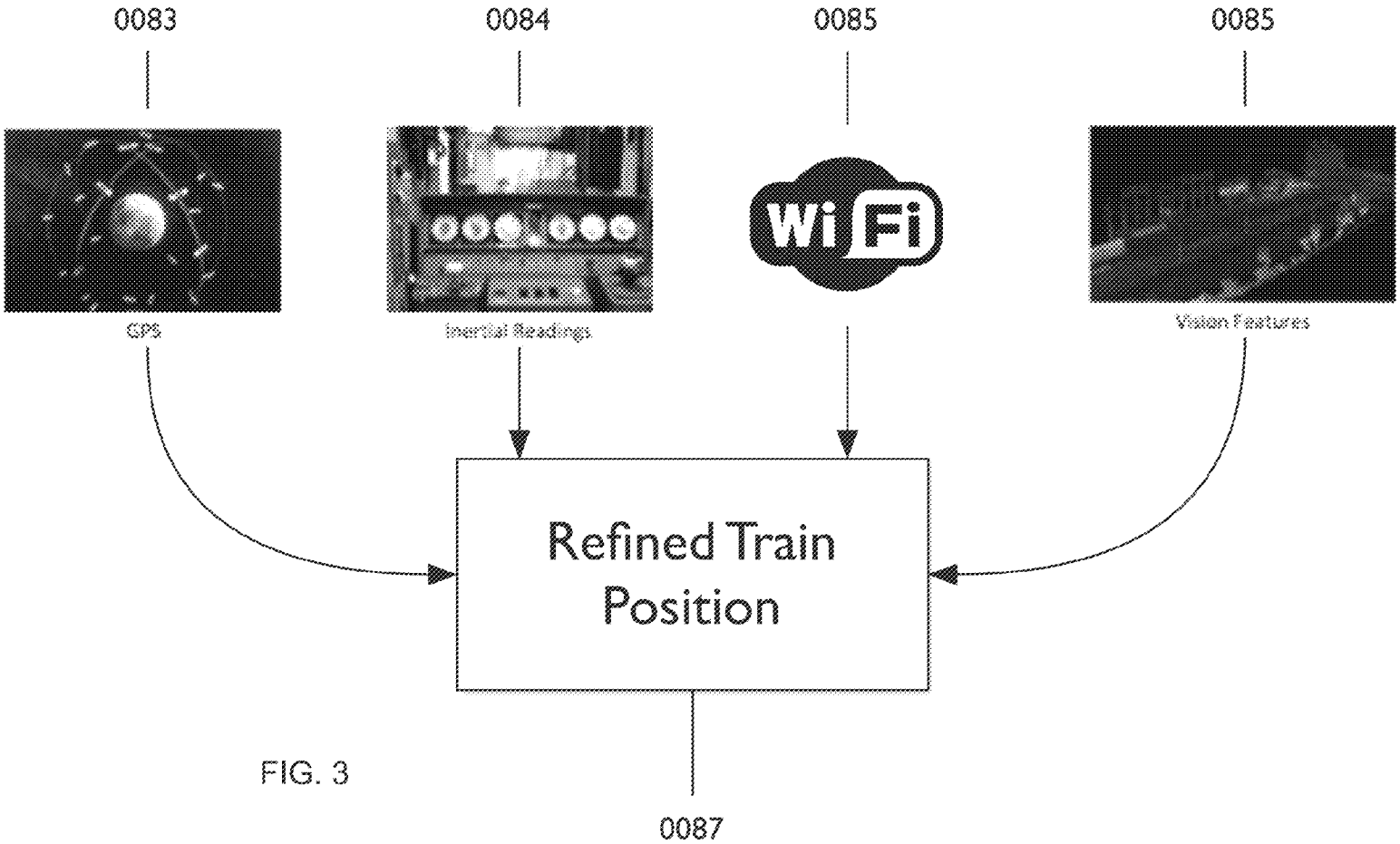
FIG. 3 is a representative flow diagram for obtaining positional information.

The Position Refinement Algorithm, as depicted in FIG. 3, provides a high confidence geolocation service onboard the train. The purpose of this algorithm is to ensure that loss of geolocation services does not occur when a single sensor fails. The PRA relies on redundant geolocation services to obtain the track position.

GPS or Differential GPS may be utilized to obtain fairly accurate geolocation coordinates.

Tachometer data along with directional heading information can be utilized to calculate an offset position.

A WiFi antenna may scan SSIDs along with signal strength of each SSID while GPS is working and later use the Medium Access Control (MAC) addresses (or any unique identifier associated with an SSID) to quickly determine the geolocation coordinates. The signal strength of the SSID during the scan by a WiFi antenna may be utilized to calculate the position relative to the original point of measurement. The PTC vision system may choose to insert the SSID profile (SSID name, MAC address, geolocation coordinates, signal strength) as a reference point into a database based on the confidence in the current train's geolocation.

Global feature vectors created by the PTC vision system may be utilized to lookup geolocation coordinates to further ensure accuracy of the geolocation coordinates.

A scoring mechanism that takes samples from all the components described above would filter out for inconsistent samples that might inhibit a train's ability to obtain geolocation information. Furthermore, the samples may carry different weightage based on the performance and accuracy of each subcomponent in the PRA.

PTC Vision System High Level Process Description

Figure 9:
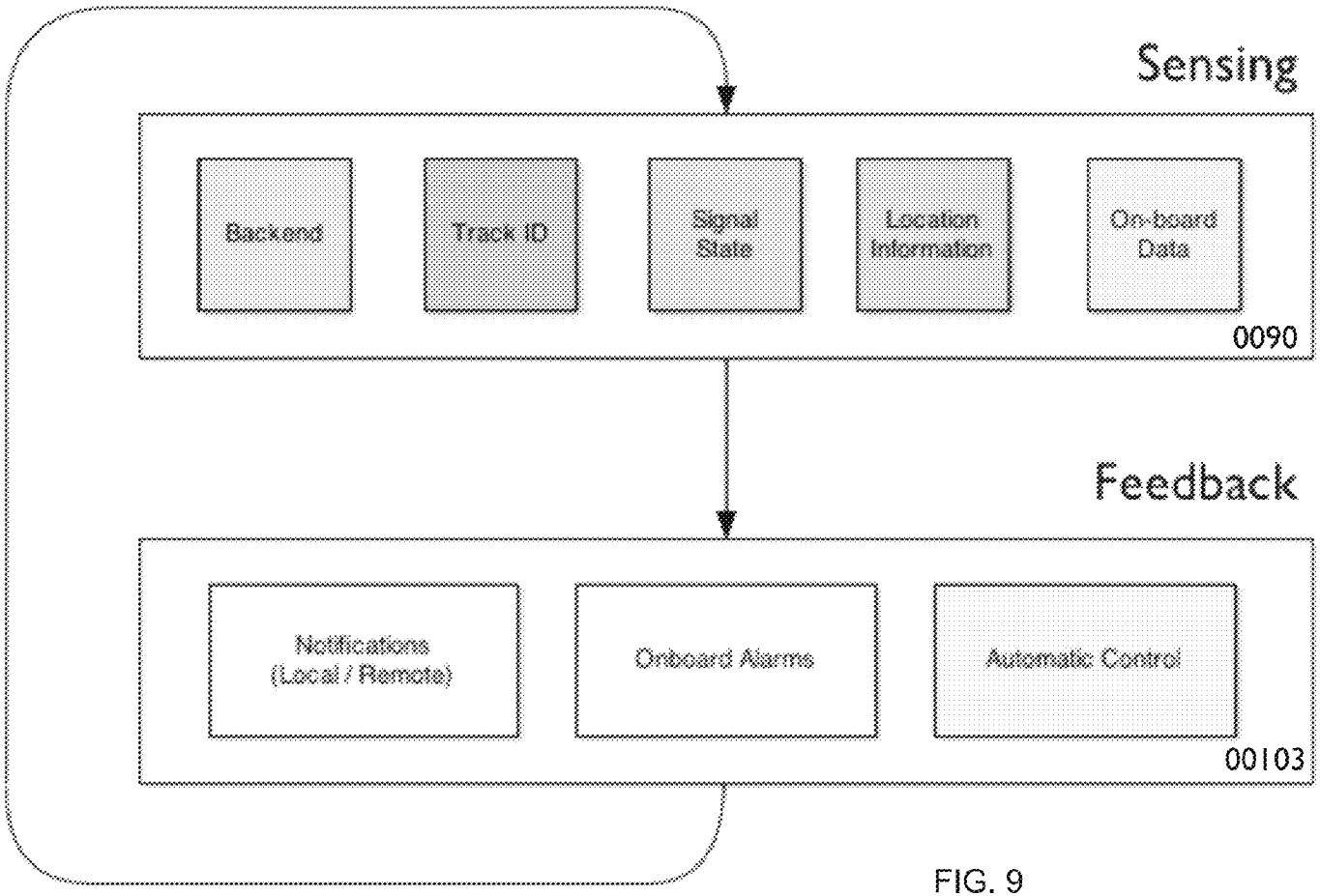
FIG. 9 is a representative flow diagram which depicts sensing and feedback.

In this section, we refer to the flowchart shown in FIG. 9. The PTC vision system samples the train state from the various subsystems described above. The train state is defined as a comprehensive overview of track, signal and on-board information. In particular the state consists of track ID, signal state of relevant signals, relevant on-board information, location information (pre- and post-refinement, reference PRA, TIA and SSA algorithms described above), and information obtained from backend servers. These backend servers hold information pertaining to the railroad infrastructure. A backend database of assets is accessed remotely by the moving vehicle as well as railroad operators and officers. The moving train and its conductor for example use this information to anticipate signals along the route. Operator and maintenance officers have access to track information for example. These reports and notifications are relevant to signals and signs, structures, track features and assets, safety information.

After collecting this state, the PTC vision system issues notifications (local or remote), possibly raises alarms on-board the train, and can automatically control the train's inertial metrics by interfacing with various subsystems on-board (e.g., traction interface, braking interface, traction slippage system).

Sensory Stage

On-board data: The On-board data component represents a unit where all the data extracted from the various train systems is collected and made available. This data usually includes but is not limited to:

- Time information
- Diagnostics information from various onboard devices
- Energy monitoring information
- Brake interface information
- Location information
- Signaling state obtained from train interfaces to wayside equipment
- Environmental state obtained through the VA devices on board or on other trains
- Any other data from components that would help in Positive Train Control This data is made available within the PTC vision system for other components and can be transmitted to remote servers, other trains, or wayside equipment.

Location data is strategic to ensure that trains are operating within a safety envelope that meets the Federal Railroad Administration's PTC criteria. In this regard, wayside equipment is currently being utilized by the industry to accurately determine vehicle position. The output of location services described above (e.g., TIA & SSA) provides the relative track position based on computer vision algorithms.

The relative position can be obtained through using a single sensor or multiple sensors. The position we obtain is returned as an offset position, usually denoted as a relative track number. Directional heading can also be a factor in building a query to obtain the absolute position from the feedback to the train.

The absolute position can be obtained either from a cached local database, or cached local dataset, remote database, remote dataset, relative offset position using on board inertial metric data, GPS samples, Wi-Fi SSIDs and their respective signal strength or through synchronization with existing wayside signaling equipment.

The various types of datasets we use include but are not limited to:

- 3D point cloud datasets
- FLIR imaging
- Video buffer data from on-board cameras Once the location is known, this information can be utilized to correlate signal state from wayside signaling to the corresponding track. The location services can also be exposed to third party listeners. The on board components defined in the PTC vision system can act as listeners to the location services. In addition, the train can scan the MAC IDs of the networked devices in the surrounding areas and utilize MAC ID filtering for any application these networked devices are utilizing. This is useful for creating context aware applications that depend on the pairing the MAC ID of a third party device (e.g., mobile phones, laptops, tablets, station servers, and other computational devices) with a train's geolocation information.

The track signal state is important for ensuring the train complies with the PTC safety envelope at all times. The PTC vision system's functional scope includes extrapolating the signal value from wayside signaling (semaphore signal state). In this regard, the communication module or the vision apparatus may identify the signal values of the wayside equipment. In areas where the signal is not visible, a central back end server can relay the information to the train as feedback. When wayside equipment is equipped with radio communication, this information can also augment the vision-based signal extrapolation algorithms (e.g., TIA & SSA). Datasets are used at the discretion of the PTC vision system.

Utilizing datasets collected by the PTC vision system, one can identify the features of the track from the rest of the data in the apparatus and identify the relative track position. The relative track position along with directional heading information can be sent to a backend server to obtain the absolute track ID. The absolute track ID denotes the track identification as listed by the operator. This payload is arbitrary to the train, allowing seamless operations amongst multiple operators without having an operator specific software stack on the train. Operator agnostic software allows trains to operate with great interoperability, even if it is traveling through infrastructures from different rail operators. Since the payloads are arbitrary, the trains are intrinsically interoperable even when switching between rail-operators. As the rolling stock travels along the track, data necessary for updating asset information is generated by the vision apparatus. This data then gets processed to verify the integrity of certain asset information, as well as update other asset information. Missing assets, damaged assets or ones that have been tampered with can then be detected and reported. The status of the infrastructure can also be verified, and the operational safety can be assessed, every time a vehicle with the vision apparatus travels down the track. For example, clearance measurements are performed making sure that no obstacles block the path of trains. The volume of ballast supporting the track is estimated and monitored over time.

Backend:

The backend component has many purposes. For one, it receives, annotates, stores and forwards the data from the trains and algorithms to the various local or remote subscribers. The backend also hosts many processes for analyzing the data (in real-time or offline), then generating the correct output. This output is then sent directly to the train as feedback, or relayed to command and dispatch centers or train stations.

Some of the aforementioned processes can include:

- Algorithms to reduce headways between trains to optimize the flow on certain corridors
- Algorithms that optimize the overall flow of the network by considering individual trains or corridors
- Collision avoidance algorithms that constantly monitor the location and behavior of the trains The backend also hosts the asset database queried by the moving train to obtain asset and infrastructure information, as required by rolling stock movement regulations. This database holds the following assets with relevant information and features:

- PTC assets
- ETCS assets
- Tracks
- Signals
- Signal lights
- Permanent speed restrictions
- Catenary structures
- Catenary wires
- Speed limit Signs
- Roadside safety structures
- Crossings Pavements at crossings
Clearance point locations for switches installed on the main and siding tracks
Clearance/structure gauge/kinematic envelope
Beginning and ending limits of track detection circuits in non-signaled territory
Sheds
Stations
Tunnels
Bridges
Turnouts
Cants
Curves
Switches
Ties
Ballast
Culverts
Drainage structures
Vegetation ingress
Frog (crossing point of two rails)
Highway grade crossings
Integer mileposts
Interchanges
Interlocking/control point locations
Maintenance facilities
Milepost signs
Other signs and signals The rolling stock vehicle utilizes the information queried from the database to refine the track identification algorithm, the position refinement algorithm and the signal state detection algorithm. The train (or any other vehicle utilizing the machine vision apparatus) moving along/in close proximity to the track collects data necessary to populate, verify and update the information in the database. The backend infrastructure also generates alerts and reports concerning the state of the assets for various railroad officers.

Feedback Stage

Figure 5:
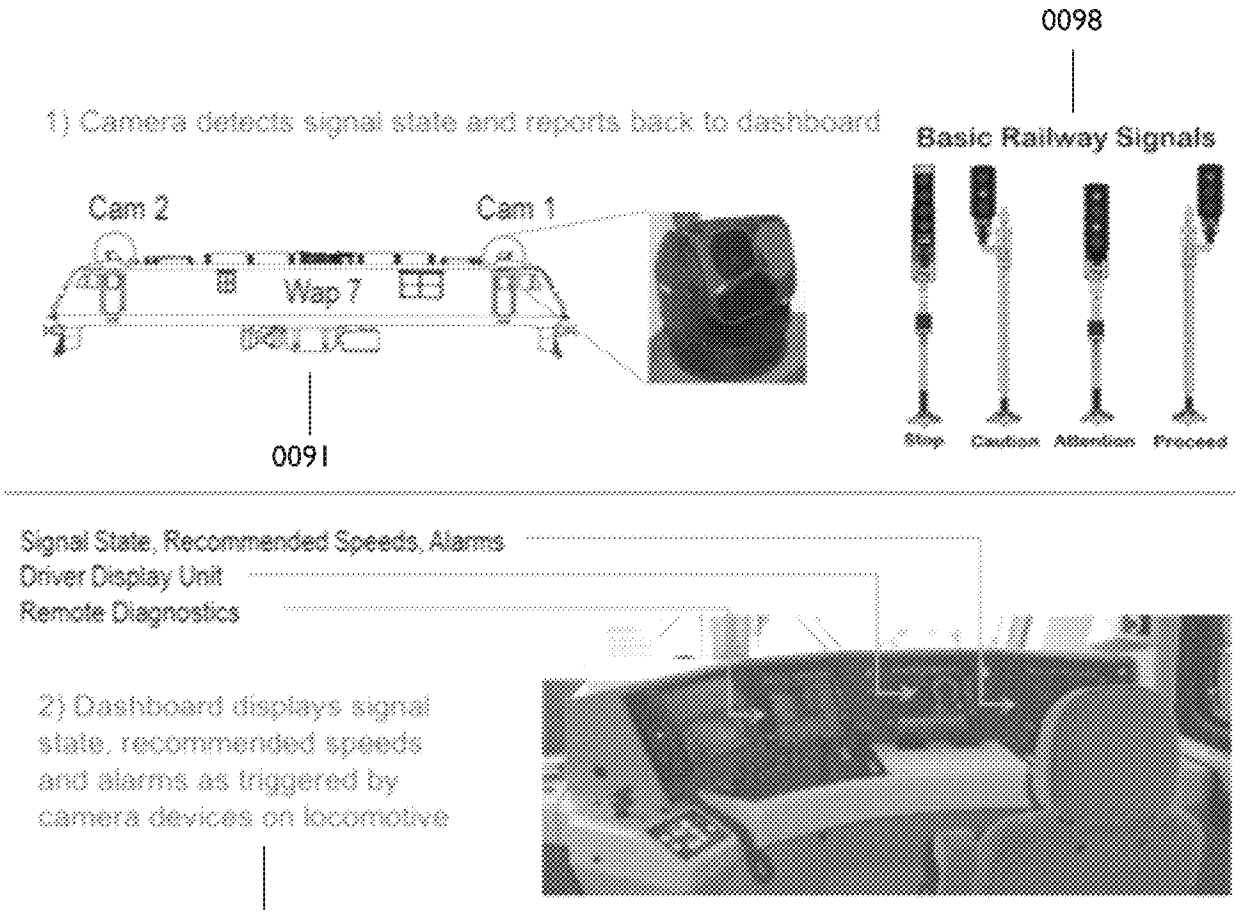
FIG. 5 is a exemplary depiction of the various interfaces available to the conductor as feedback.

Automatic Control:

There are several ways with which the train can be controlled using the PTC vision system (e.g., Applications in FIG. 5). The output of the sensory stage might trigger certain actions independently of the any other system. For example, upon the detection of a red-light violation, the braking interface might be triggered automatically to attempt to bring the train to a stop.

Certain control commands can also arrive to the train through its VCD. As such, the backend system can for example instruct the train to increase its speed thereby reducing the headway between trains. Other train subsystems might also be actuated through the PTC vision system, as long as they are accessible on the locomotive itself.

Onboard Alarms:

Feedback can also reach the locomotive and conductor through alarms. In the case of a red-light violation for example, an alarm can be displayed on the HMI. The alarms can accompany any automatic control or exist on its own. The alarms can stop by being acknowledged or halt independently.

Notifications (Local/Remote):

Feedback can be in the form of notifications to the conductor through the user interface of the HMI module. These notifications may describe the data sensed and collected locally through the PTC vision system, or data obtained from the backend systems through the VCD. These notifications may require listeners or may be permanently enabled. An example of a notification can be about speed recommendations for the conductor to follow.

Backend architecture and data processing.

The backend may have two modules: data aggregation and data processing. Data aggregation is one module whose role is to aggregate and route information between trains and a central backend. The data processing component is utilized to make recommendations to the trains. The communication is bidirectional and this backend server can serve all of the various possible applications from the PTC vision system.

Possible applications for PTC vision system include the following:

Signal detection
Track detection
Speed synchronization
Extrapolating interlocking state of track and relaying it back to other trains in the network
Fuel optimization
Anti-Collision system
Rail detection algorithms
Track fault detection o preventative derailment detection
Track performance metric
Image stitching algorithms to create comprehensive reference datasets using samples from multiple runs
Cross Train imaging:
  Preventative maintenance
  Fault detection
  Vibration signature of passerby trains
Imaging based geolocation or geofiltering services
SSID based geolocation or geofiltering
Sensory fusion of GPS+Inertial Metrics+Computer Vision-based algorithms The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below.

What is claimed is:

1. A vehicle localization apparatus comprising:

a GPS receiver mounted to a vehicle, the GPS receiver providing a first geographical position of the vehicle;

a local map cache residing within the vehicle, the local map cache storing a local map of assets comprising, for each asset: a location of the asset, properties associated with the asset, and one or more relationships relative to other assets;

one or more local environment sensors mounted on the vehicle to enable collection of data comprising, for observed assets present in a local environment in the vicinity of the vehicle: position data of the observed assets relative to the vehicle, and properties associated with the observed assets;

one or more vehicle computers, the vehicle computers receiving the first geographical position from the GPS receiver to retrieve, from the local map cache, records associated with assets previously mapped in the vicinity of the first geographical position;

a feature extraction component implemented by the vehicle computers, the feature extraction component receiving the local environment sensor data to identify and locate observed assets presently within the vicinity of the vehicle; and a position refinement component implemented by the vehicle computers, the position refinement component comparing the identity and location of observed assets from the feature extraction component with asset information retrieved from the local map cache to determine a second position of the vehicle that is refined relative to the first geographical position of the vehicle;

a wireless vehicular communication device via which the local map cache can download local map data from a remote database during vehicle operation; and a map audit component identifying differences between the local map of assets and the observed assets and outputting said differences to the vehicular communication device for transmission to the remote database.

2. The vehicle localization apparatus of claim 1, in which the map audit component comprises a missing asset detector identifying assets that are present within the observed assets and not present within the local map of assets, or that are not present within the observed assets and present within the local map of assets.

3. The vehicle localization apparatus of claim 1, in which the map audit component comprises an asset alteration detector identifying assets within the observed assets having characteristics indicative of damage or tampering that differ from characteristics associated with the asset within the local map of assets.

4. A vehicle localization apparatus comprising:

a GPS receiver mounted to a vehicle adapted for travel on railway tracks, the GPS receiver providing a first geographical position of the vehicle;

a local map cache residing within the vehicle, the local map cache storing a local map of assets comprising, for each asset: a location of the asset, properties associated with the asset, and one or more relationships relative to other assets;

one or more local environment sensors mounted on the vehicle to enable collection of data comprising, for observed assets present in a local environment in the vicinity of the vehicle: position data of the observed assets relative to the vehicle, and properties associated with the observed assets;

one or more vehicle computers, the vehicle computers receiving the first geographical position from the GPS receiver to retrieve, from the local map cache, records associated with assets previously mapped in the vicinity of the first geographical position;

a feature extraction component implemented by the vehicle computers, the feature extraction component receiving the local environment sensor data to identify and locate observed assets presently within the vicinity of the vehicle; and a position refinement component implemented by the vehicle computers, the position refinement component comparing the identity and location of observed assets from the feature extraction component with asset information retrieved from the local map cache to determine a second position of the vehicle that is refined relative to the first geographical position of the vehicle;

a wireless vehicular communication device via which the local map cache can download local map data from a remote database during vehicle operation; and a track clearance evaluation component receiving information from the feature extraction component indicating a location of a first asset, the track clearance evaluation component identifying the first asset as an obstruction and reporting the obstruction location to a backend server via the vehicular communication device.

5. A method of updating asset information within a centralized map database implemented by one or more network-connected servers, the method comprising the steps of:

receiving by the centralized map database a request for map data from a remote vehicle, where the vehicle is a train, the vehicle having local environment sensors and a local map cache;

transmitting a first set of map data from the centralized map database to the remote vehicle in response to the request, the first set of map data comprising asset information, the asset information comprising identification, features and location of one or more assets; and receiving at the centralized map database, from the remote vehicle, a report indicative of one or more differences between the first set of map data and information detected by the vehicle local environment sensors, the report indicative of obstruction clearance relative to the path of the train; and updating the centralized map database based on information within the report.

* * * * *